US007823657B2

(12) United States Patent
Zeni

(10) Patent No.: US 7,823,657 B2
(45) Date of Patent: Nov. 2, 2010

(54) DRILLING ASSEMBLY, DRILLING REAMER ARM ASSEMBLY, AND METHODS OF DRILLING

(75) Inventor: John Zeni, Maidsville, WV (US)

(73) Assignee: Abergeldie Holdings Pty Ltd/Abergeldie Plant Pty Ltd. (AU)

( * ) Notice: Subject to any disclaimer, the term of this patent is extended or adjusted under 35 U.S.C. 154(b) by 365 days.

(21) Appl. No.: 12/014,333

(22) Filed: Jan. 15, 2008

(65) Prior Publication Data

US 2009/0178852 A1 Jul. 16, 2009

(51) Int. Cl.
*E21B 7/00* (2006.01)

(52) U.S. Cl. ..... 175/57; 175/357; 175/368; 175/413

(58) Field of Classification Search ..... 175/57, 175/256, 346, 347, 357, 364, 368, 412, 413
See application file for complete search history.

(56) References Cited

U.S. PATENT DOCUMENTS

| | | | | |
|---|---|---|---|---|
| 2,680,597 | A * | 6/1954 | Brown | 175/385 |
| 5,111,893 | A | 5/1992 | Kvello-Aune | |
| 5,429,198 | A | 7/1995 | Anderson et al. | |
| 6,059,051 | A | 5/2000 | Jewkes et al. | |
| 7,083,010 | B2 | 8/2006 | Eppink et al. | |
| 2004/0159468 | A1 | 8/2004 | Hoffmaster et al. | |
| 2004/0222022 | A1 | 11/2004 | Nevlud et al. | |
| 2005/0205305 | A1 | 9/2005 | Stout et al. | |
| 2007/0095574 | A1 | 5/2007 | Savignat | |

FOREIGN PATENT DOCUMENTS

| | | |
|---|---|---|
| EP | 1625276 | 5/2004 |
| WOWO | PCT/US2009/030995 | 8/2009 |

* cited by examiner

*Primary Examiner*—Kenneth Thompson
*Assistant Examiner*—Cathleen R Hutchins
(74) *Attorney, Agent, or Firm*—Wells St. John P.S.

(57) ABSTRACT

This invention includes drilling assemblies, drilling reamer arm assemblies, and methods of drilling. In one implementation, a drilling assembly includes a cutting head apparatus configured to cut into earthen material as the cutting head apparatus is rotated. A drive shaft extends aft of and is configured to rotate the cutting head apparatus. A plurality of reamer arm assemblies projects radially outward of the drive shaft and are mounted for rotation therewith aft of the cutting head apparatus. Individual of the reamer arm assemblies include a radial inner portion extending radially outward of the drive shaft. A radial outer portion connects with and extends radially outward of the radial inner portion. The radial outer portion includes a cutter. At least one breakaway retainer fastens the radial inner and outer portions together and restrains the radial outer portion from moving relative to the radial inner portion towards the cutting head apparatus and the drive shaft. Other aspects are contemplated.

1 Claim, 12 Drawing Sheets

DRILLING ASSEMBLY, DRILLING REAMER ARM ASSEMBLY, AND METHODS OF DRILLING

TECHNICAL FIELD

This invention relates to drilling assemblies, to drilling reamer arm assemblies, and to methods of drilling.

BACKGROUND OF THE INVENTION

When drilling wells into the earth, a string of drill pipe is rotated and driven into the earth to form the hole or well. Water is typically flowed into the well during drilling, with the water and removed earthen material flowing upwardly around or within the rotating drill pipe and outwardly of the bore hole being drilled.

One example prior art drilling assembly uses stabilizers and reamer arm assemblies aft (up-hole) of the cutting head apparatus. For example, a cutting head apparatus is provided at the end of a drill string assembly and is configured to cut into earthen material as the cutting head apparatus is rotated. A drive shaft extends aft of and is configured to rotate the cutting head apparatus as driven by the drill string assembly. The drive shaft is rotatably received between a pair of stabilizer assemblies received proximate the cutting head apparatus. The stabilizer assemblies include a plurality of radially projecting arms respectively having pairs of solid rubber tires mounted for rotation about horizontal axes at the outer ends of the arms, and which bear against the sidewalls of the bore hole. The outermost diameter extent of the stabilizers is slightly greater than the outermost diameter of the cutting head such that the stabilizer tires compress and bear tightly against the bore hole aft of the cutter head as the drilling assembly is advanced into the earth. The drive shaft is rotatably received through the stabilizer assemblies which essentially act as bearings for restraining the cutting head apparatus from appreciable lateral movement as it is advanced into the earth.

A plurality of reamer arm assemblies is received between the pair of stabilizers and mount to the drive shaft for rotation therewith. The individual reamer arms have a pair of cutters received at the radially outer ends thereof. Opposing pairs of reamer arm assemblies have an outermost diameter extent which is slightly less than the outermost diameter of the cutting head apparatus. An intended function of the reamers is to follow behind the cutting head to cut a smooth finish to the bore hole by carving off undulations that might occur in the path of cutting through the rock/earthen material, and facilitate the cutting apparatus going straight.

At the conclusion of drilling, the entire drilling assembly is of course removed from the bore hole. The reamer arm assemblies, being in close proximity to the sidewalls of the bore hole, on occasion engage such sidewalls, causing the entire apparatus to essentially get "stuck" in the bore hole. Such can require lowering of the drilling assembly slightly within the borehole and rotating it slightly prior to again attempting to extract the drilling assemble from the bore hole. Such is, of course, time consuming and may cause damage to the cutters on the reamer arm assemblies.

While the invention was motivated in addressing the above identified issues, it is in no way so limited. The invention is only limited by the accompanying claims as literally worded, without interpretative or other limiting reference to the specification, and in accordance with the doctrine of equivalents.

SUMMARY

This invention comprises drilling assemblies, drilling reamer arm assemblies, and methods of drilling. In one implementation, a drilling assembly includes a cutting head apparatus configured to cut into earthen material as the cutting head apparatus is rotated. A drive shaft extends aft of and is configured to rotate the cutting head apparatus. A plurality of reamer arm assemblies project radially outward of the drive shaft and are mounted for rotation therewith aft of the cutting head apparatus. Individual of the reamer arm assemblies include a radial inner portion extending radially outward of the drive shaft. A radial outer portion connects with and extends radially outward of the radial inner portion. The radial outer portion includes a cutter. At least one breakaway retainer fastens the radial inner and outer portions together and restrains the radial outer portion from moving relative to the radial inner portion towards the cutting head apparatus and the drive shaft.

In one implementation, a drilling reamer arm assembly includes a radial inner portion and a radial outer portion connected with and extending radially outward of the radial inner portion. The radial outer portion comprises a cutter. At least one breakaway retainer fastens the radial inner and outer portions together.

Other aspects and implementations, including method, are contemplated.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
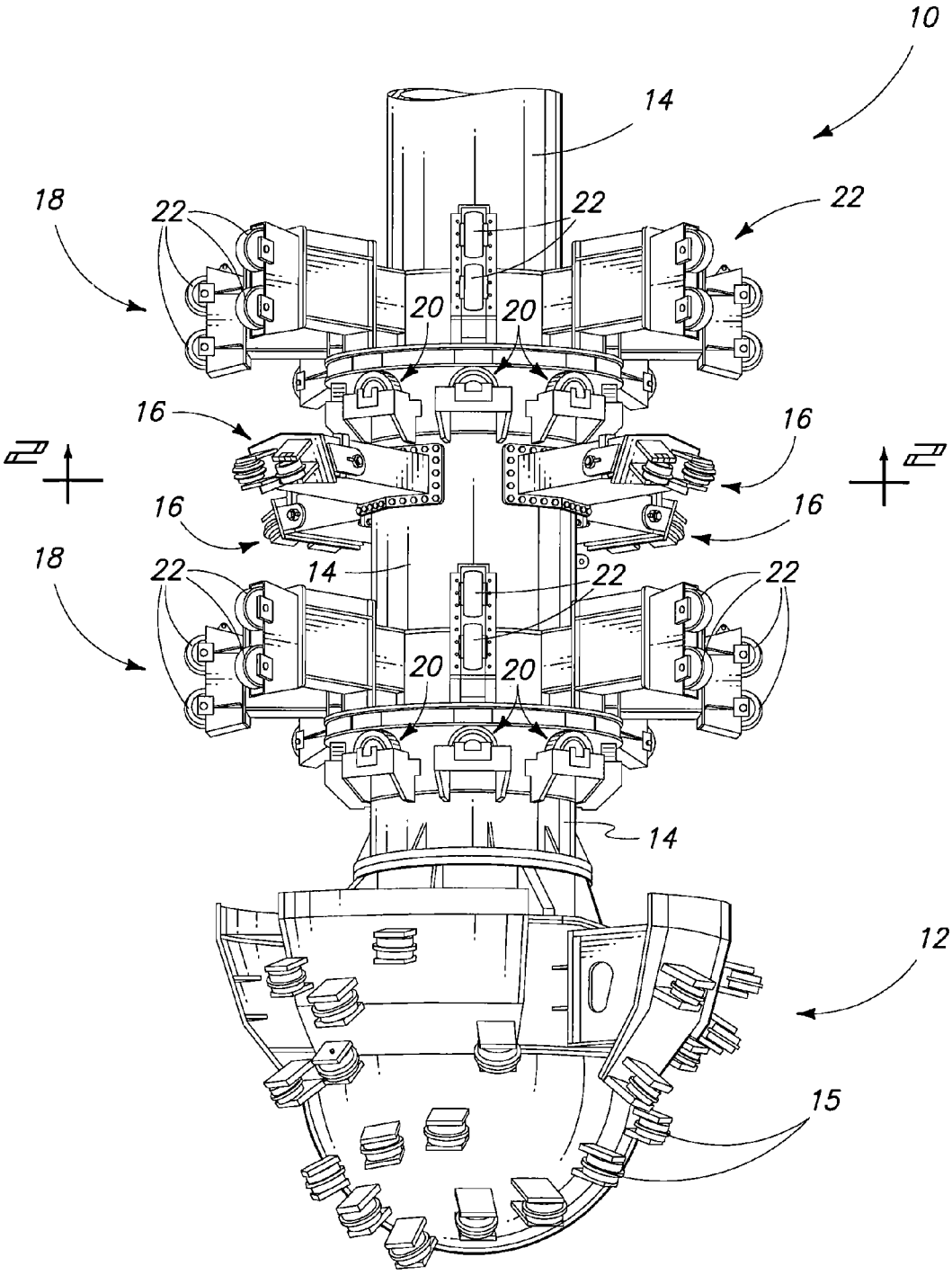
FIG. 1 is a diagrammatic perspective view of a drilling assembly in accordance with an embodiment of the invention.
Figure 2:
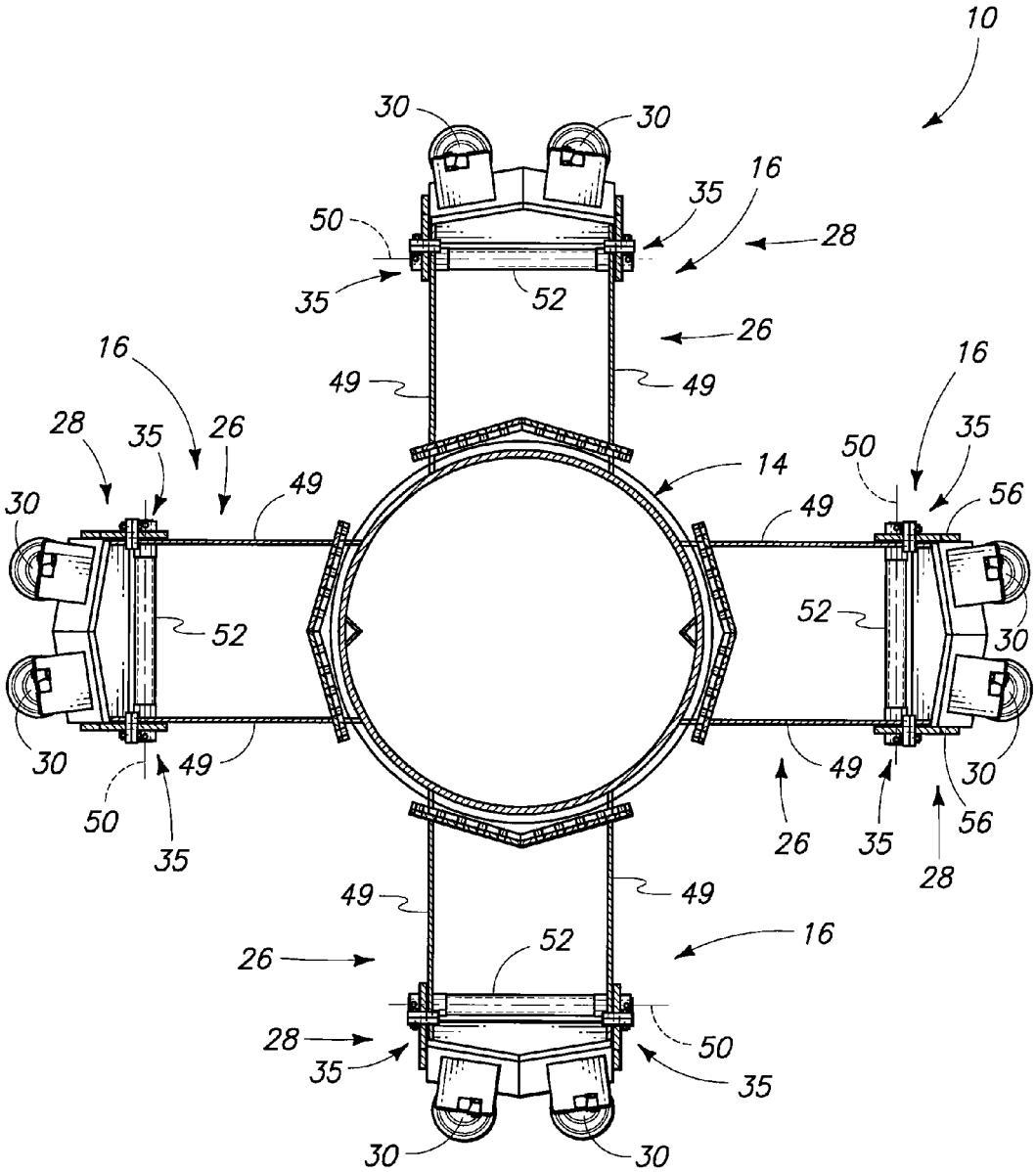
FIG. 2 is an enlarged upward diagrammatic sectional view of the FIG. 1 assembly taken through line 2-2 in FIG. 1.

Referring initially to FIG. 1, a drilling assembly, in accordance with one embodiment of the invention is indicated generally with reference numeral 10. Such includes a cutting head apparatus 12 configured to cut into earthen material as cutting head apparatus 12 is rotated. A drive shaft 14 extends aft (i.e., up-hole) of cutting head apparatus 12 and is configured to rotatably drive the cutting head. Cutting head apparatus 12 is depicted as comprising a plurality of cutters 15 for cutting into earthen material.

A plurality of reamer arm assemblies 16 project radially outward of drive shaft 14 and are mounted for rotation therewith aft of cutting head apparatus 12. Two preferred sets of stabilizer assemblies 18, as described in the "Background" section above, are received about drive shaft 14 above and below reamer arm assemblies 16. Drive shaft 14 is provided with a plurality of roller wheel assemblies 20 upon which stabilizer assemblies 18 are supported such that drive shaft 14, with cutting head apparatus 12 and reamer arm assembly 16, is rotatable relative to stabilizer assemblies 18. Stabilizer assemblies 18 include outermost solid rubber tires 22, which bear against and compress relative to the sidewalls of the borehole being drilled. By way of example only, stabilizer assemblies 18 may be provided with a diametric outermost extent which is 80 millimeters greater than that of the diametric outermost extent of cutting head apparatus 12 such that the tires bear tightly and compress against sidewalls of the bore hole which is being advanced. Further by way of example only, an outermost diameter for cutting head apparatus 12 is about 19.35 feet. Also by way of example only, reamer arm assemblies 16 may be provided with a diametric outermost extent which is from about 10 to 15 millimeters less than that of the diameter extent of cutting head apparatus 12

Aspects of the invention include a drilling assembly as well as individual drilling reamer arm assemblies independent of a drilling assembly, for example individual drilling reamer arm assembly 16.

Referring to FIGS. 1-4, four individual reamer arm assemblies 16 are shown oriented in opposing radial pairs essentially at 90° cardinal points about drive shaft 14. More or fewer individual reamer arm assemblies might of course be utilized, and the individual reamer arm assemblies might be identical to or different from one another. In the depicted embodiment, individual reamer arm assemblies 16 are identical to one another, and the discussion proceeds with reference to a single of such reamer arm assemblies.

Drilling reamer arm assemblies 16 can be considered as comprising a radial inner portion 26 and a radial outer portion 28. Radial outer portion 28 is connected with, and extends radially outward of, radial inner portion 26, and comprises a cutter 30. Two reamer cutters 30 are shown with respect to each reamer arm assembly 16, although fewer or more cutters might be utilized. Example cutters 30 are depicted as angling laterally outward and downward relative to the radial orientation of inner and outer portions 26, 28, and are mounted for rotation about respective axes 32. The laterally outward angling and/or the downward angling of individual reamer cutters 30 on an individual reamer arm assembly 16 might be the same or different relative each other. Alternate configurations are, of course, contemplated. Regardless, cutters 30 can be considered as having respective radially outermost working ends 34.

Reamer arm assemblies in accordance with an aspect of the invention include at least one breakaway retainer which fastens the radial inner and outer portions together. In one embodiment, such a breakaway retainer restrains the radial outer portion of the reamer arm assembly from moving relative to the radial inner portion towards the cutting head apparatus and the drive shaft. In the context of this document, a "breakaway retainer" is a device which fails by fracturing upon application of an effective breakaway force to the radial outer portion relative to the radial inner portion prior to fracture failure of any other component of the reamer arm assembly upon application of such breakaway force. Accordingly, the breakaway retainer is sized, oriented, and configured with material(s) effective to be the first to fail upon application of some minimum such effective breakaway force, for example by engagement of the cutter with the sidewalls of the bore hole upon extracting the drilling assembly outwardly of the bore hole as described by way of example below. Further by way of example only, the breakaway retainer might be configured and oriented to fail in one or a combination of tension and shear upon application of an effective breakaway force.

FIGS. 1-4 depict a pair of example breakaway retainers 35 associated with each drilling reamer arm assembly 16. Individual breakaway retainers 35 are shown as comprising an opposing pair of compression members 36 and 38, with compression member 36 being received on or comprising a part of radial inner portion 26 and compression member 38 being received on or comprising a part of radial outer portion 28. Compression members 36 and 38 have a facing surface 37, 39, respectively, which faces and bears against the facing surface of the other compression member of the pair. Compression members 36 and 38 respectively comprise a radially extending hole 40 which radially align relative one another when facing surfaces 37 and 39 bear against one another. Breakaway retainers 35 also comprise a pin 42 which is configured and oriented to fail in tension upon application of an effective breakaway force, as will be apparent from the continuing discussion. In the depicted embodiment, pin 42 is radially oriented relative to inner and outer portions 26 and 28, and extends through radial holes 40 in compression members 36 and 38. FIGS. 1-4 depict individual pins 42 as comprising a bolt having a head 44, which bears against one of radial inner portion 26 and radial outer portion 28, and a nut 46 which bears the other of radial inner portion 26 and radial outer portion 28. In the depicted example embodiment, such occurs by bolt head 44 bearing against compression member 36 of radial inner portion 26, and nut 46 bearing against compression member 38 of radial outer portion 28. Other pins with or without one or more heads might also of course be used.

Radial inner portion 26 and radial outer portion 28 are connected for movement relative one another upon failure of the depicted breakaway retainers 35, thereby enabling the radial outer portion to move relative to the radial inner portion towards the cutting head apparatus and the drive shaft. Any manner of so mounting as just stated is contemplated, and whether existing or yet-to-be developed. In one example manner and as shown in FIGS. 1-4, radial outer portion 28 is mounted for transverse pivotal movement relative to radial inner portion 26 about a transverse pivot axis 50. In the depicted example and reduction-to-practice embodiment, radial inner portion 26 comprises a steel, rectangular box channel member 49 having outer dimensions of approximately 1050 mm in width by 380 mm in height, and a wall thickness of 25 mm. Transverse pivot axis 50 is defined by a rod or pipe 52 received across and through holes in channel member 49. Radial outer portion 28 includes a pair of plates 56 received laterally outward of channel member 49 of radial inner portion 26. Plates 56 are sized and configured to be able to pivot downwardly (i.e., down-hole) relative to radial inner portion 26. Each plate 56 includes a lateral hole which aligns with the holes in channel member 49, and through which rod 52 is received. Bushings 58 are received within the aligned holes of the plates and channel members, and through which rod 52 is received.

Figure 4:
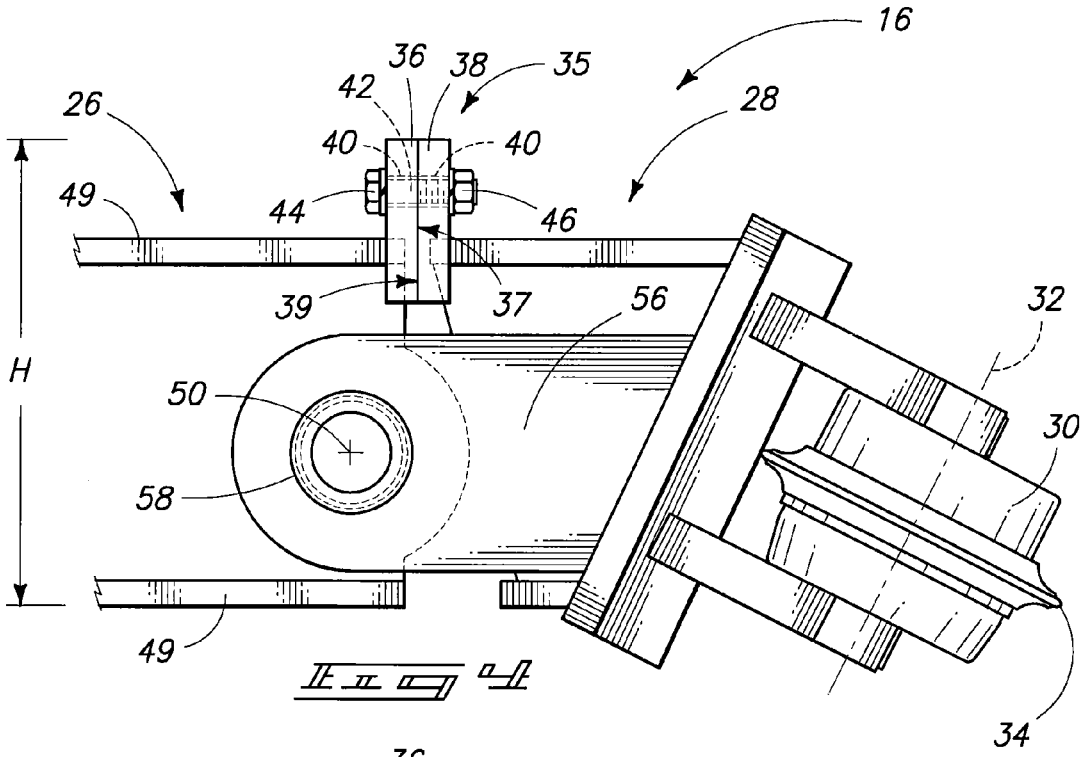
FIG. 4 is a side elevational view of the FIG. 3 drilling reamer arm assembly.

FIG. 4 depicts transverse axis 50 as being received elevationally higher than radially outermost working end 34 of cutter 30. Ideally where multiple cutters 30 are utilized having different elevation radially outermost working ends 34, transverse pivot axis 50 is received elevationally higher than the highest of such radially outermost working ends of the cutters. Further preferably and as shown, FIG. 4 also depicts breakaway retainers 35 as being received elevationally higher than transverse pivot axis 50. Further, in one embodiment, radial inner portion 26 can be considered as having a height "H", with transverse pivot axis 50 being received by radial inner portion 26 in a lower half of such height H.

Figure 5:
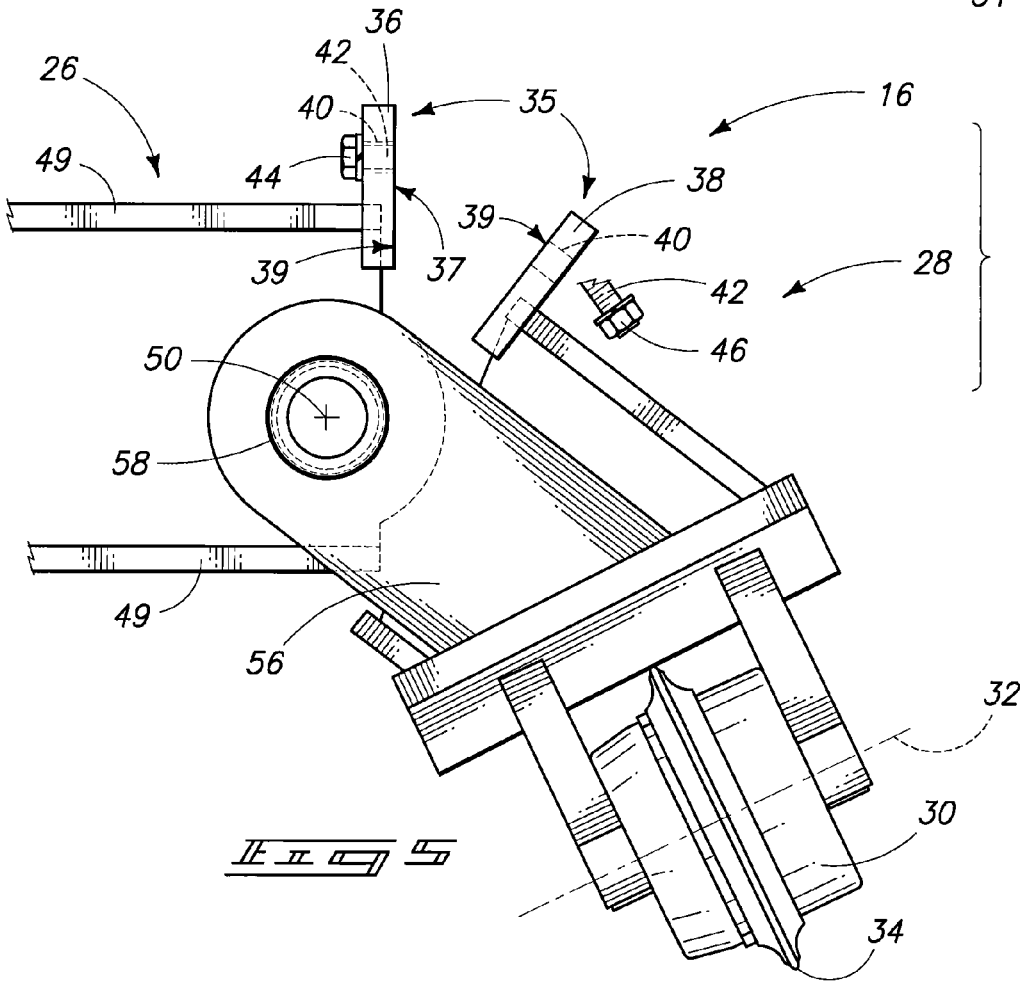
FIG. 5 is a side elevational view of the FIGS. 3 and 4 drilling reamer arm assembly in a different operational orientation to that depicted by FIG. 4.

Operation of the example drilling reamer arm assemblies 16 is next described with reference to FIGS. 4 and 5. FIG. 4 depicts drilling reamer arm assembly 16 in a normal operational drilling/reaming configuration. Facing surfaces 37 and 39 of compression plates 36 and 38, respectively, bear against one another the result of torque previously applied relative to nut/bolt pin assembly 42 (FIG. 4). Rotation of the cutting head apparatus in down-hole drilling may result in radially outermost working ends 34 of cutters 30 engaging sidewalls of the bore hole, thus applying an upward/up-hole force of radial outer member 28 relative to radial inner member 26 about pivot axis 50, and thereby against the facing compression members 36 and 38. In an alternate configuration, FIG. 5 depicts an effective breakaway force having been applied to pin 42, thereby causing its failure in tension. Such might occur by application of an effective breakaway force by engagement of cutter 30 with the sidewall of the bore hole when the drilling assembly is attempted to be raised from the bore hole, thereby resulting in a downward transverse force of radial outer portion 28 relative to radial inner portion 26 about transverse pivot axis 50.

Figure 3:
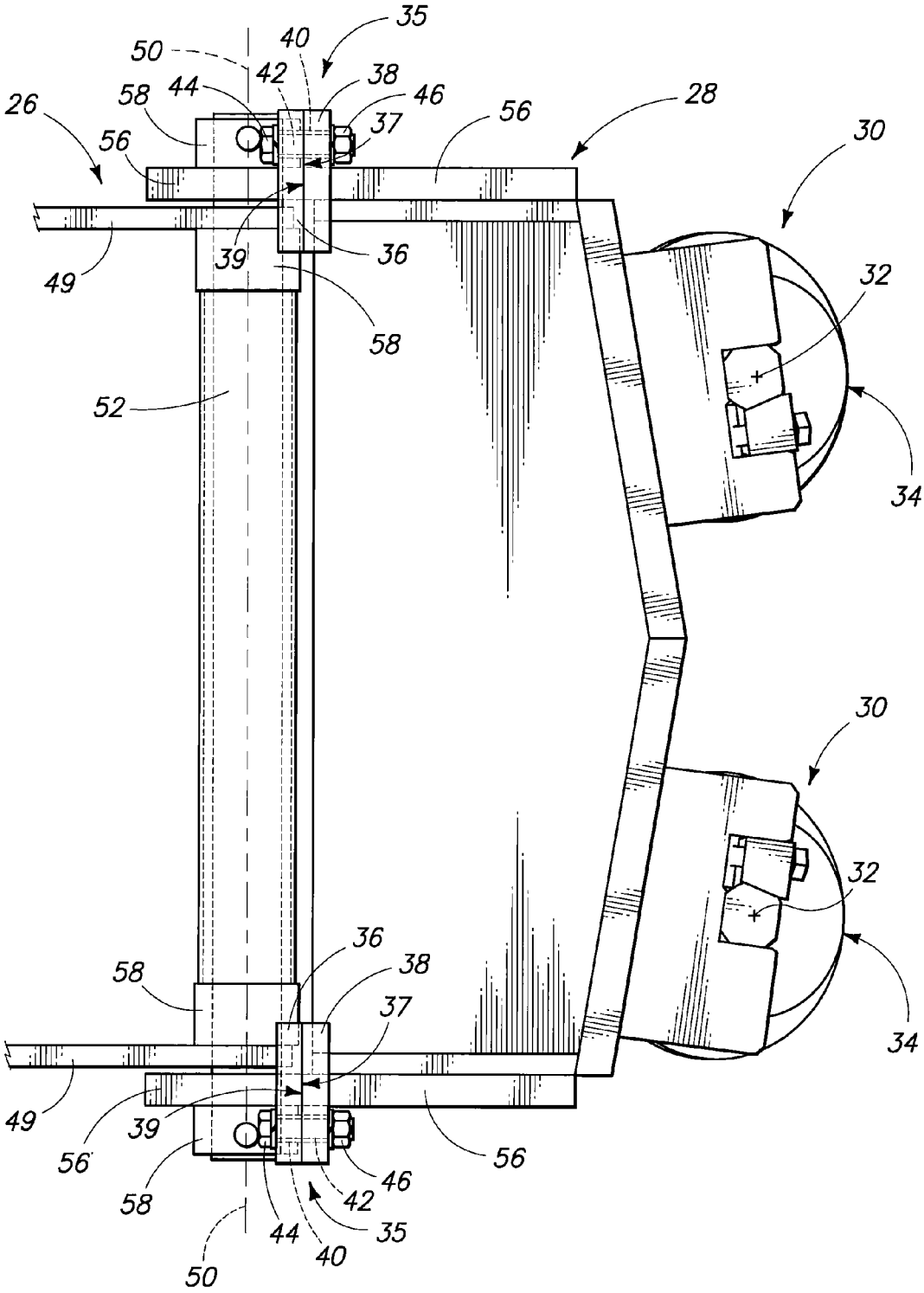
FIG. 3 in an enlarged diagrammatic top view of a portion of a drilling reamer arm assembly of the drilling assembly of FIG. 1.
Figure 6:
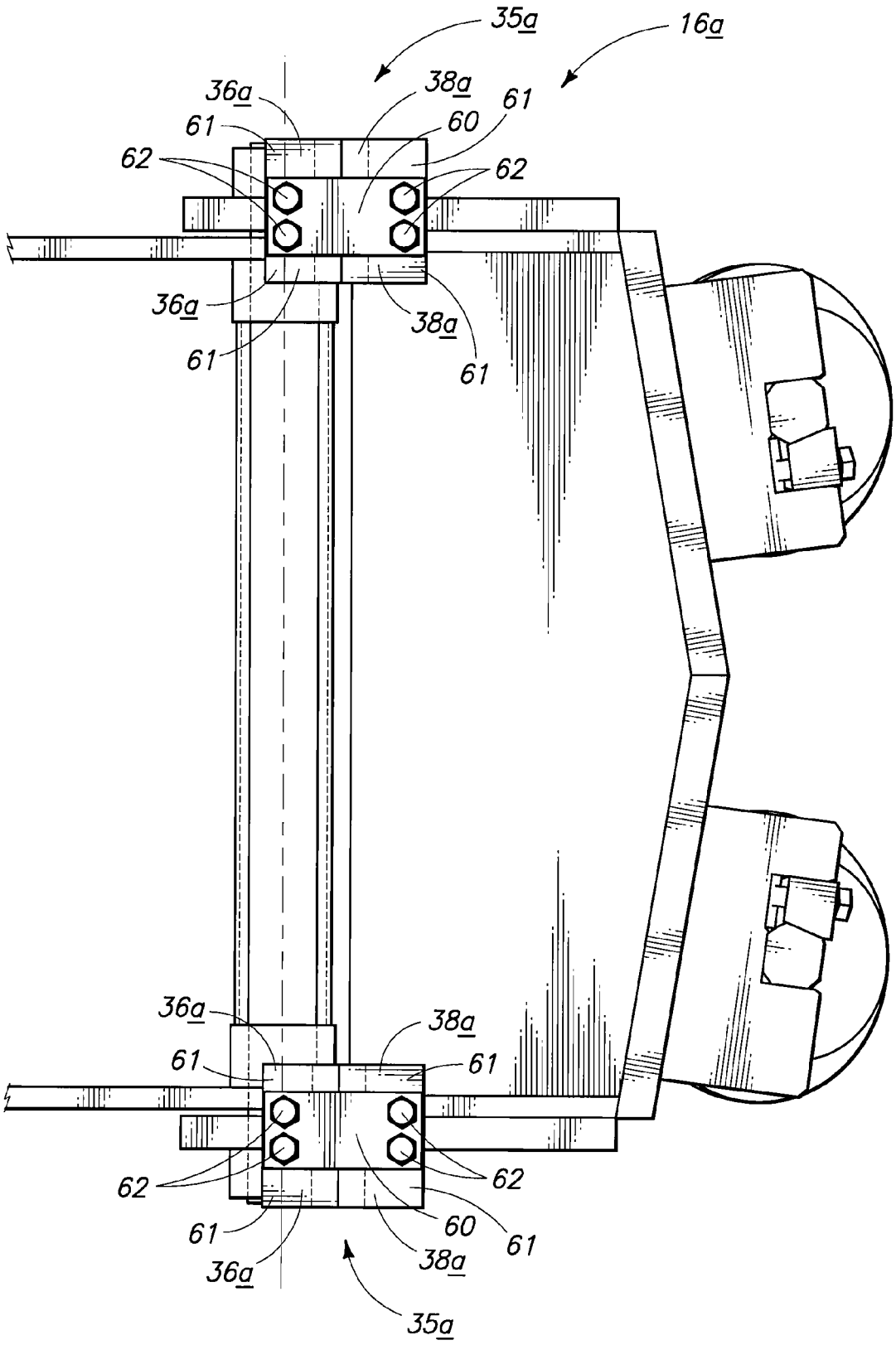
FIG. 6 is a diagrammatic top view of a portion of an alternate embodiment reamer arm assembly to that depicted by FIG. 3.
Figure 7:
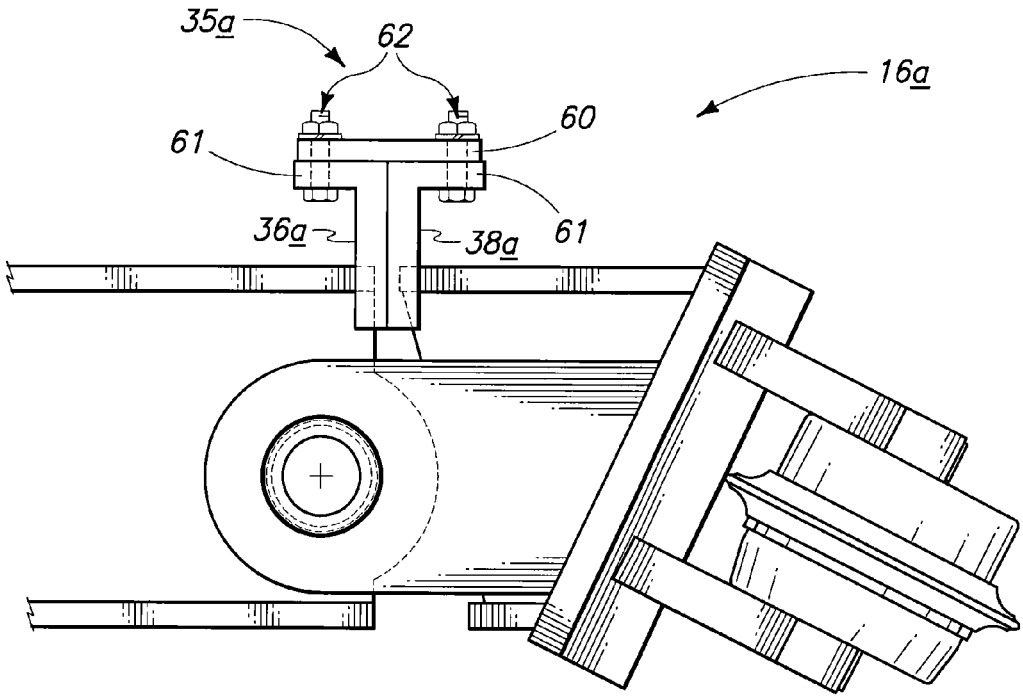
FIG. 7 is a side elevational view of the FIG. 6 drilling reamer arm assembly.
Figure 8:
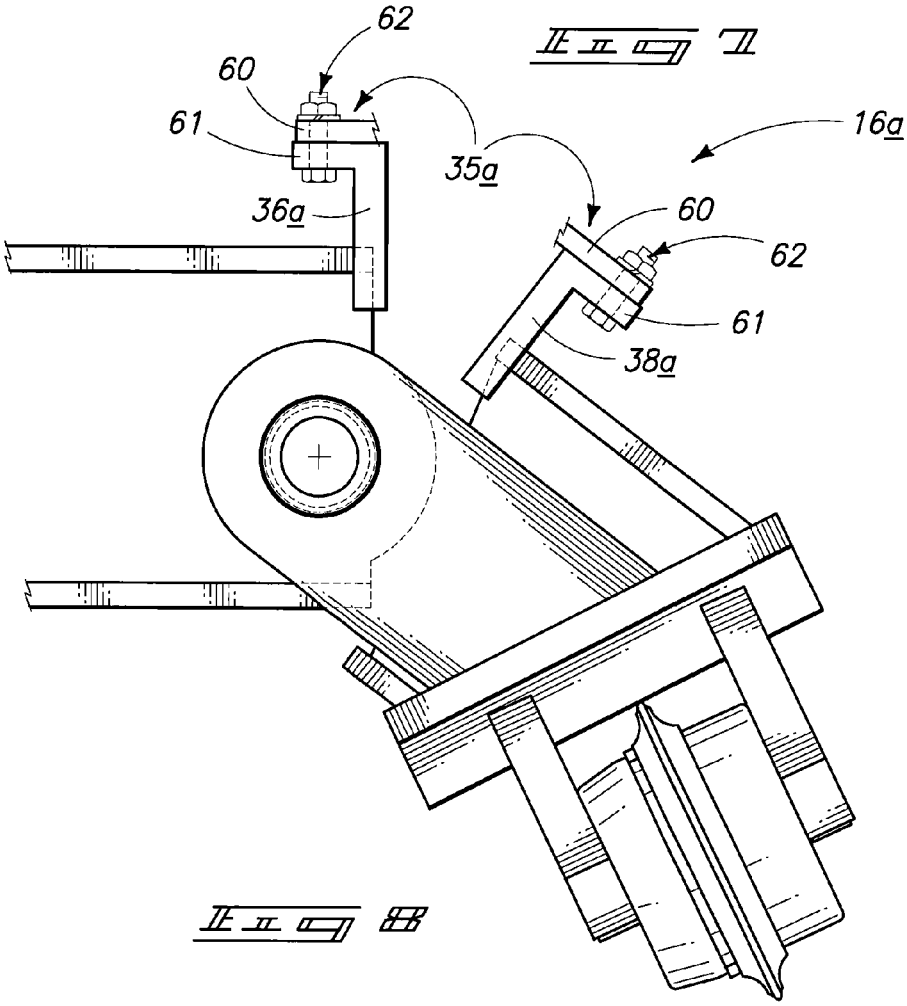
FIG. 8 is a side elevational view of the FIGS. 6 and 7 drilling reamer arm assembly in a different operational orientation to that depicted by FIG. 7.

By way of example only, FIGS. 6, 7, and 8 depict an alternate embodiment reamer arm assembly 16*a*, and correspond in orientation to that of FIGS. 3, 4, and 5, respectively. Like numerals from the first-described embodiment are utilized where appropriate, with differences being indicated with the suffix "a" or with different numerals. FIGS. 6-8 depict an alternate embodiment breakaway retainer 35*a* comprising a tension strap 60 which is configured and oriented to fail in tension upon application of an effective breakaway force. In the depicted embodiment, compression members 36*a*, 38*a* are configured with radially extending portions 61. Pairs of nut and bolt assemblies 62 bolt tension strap 60 to portions 61 of compression members 36*a*, 38*a*. FIG. 8 depicts the failure of tension straps 60 of a breakaway retainer 35*a* upon the application of an effective breakaway force.

Figure 9:
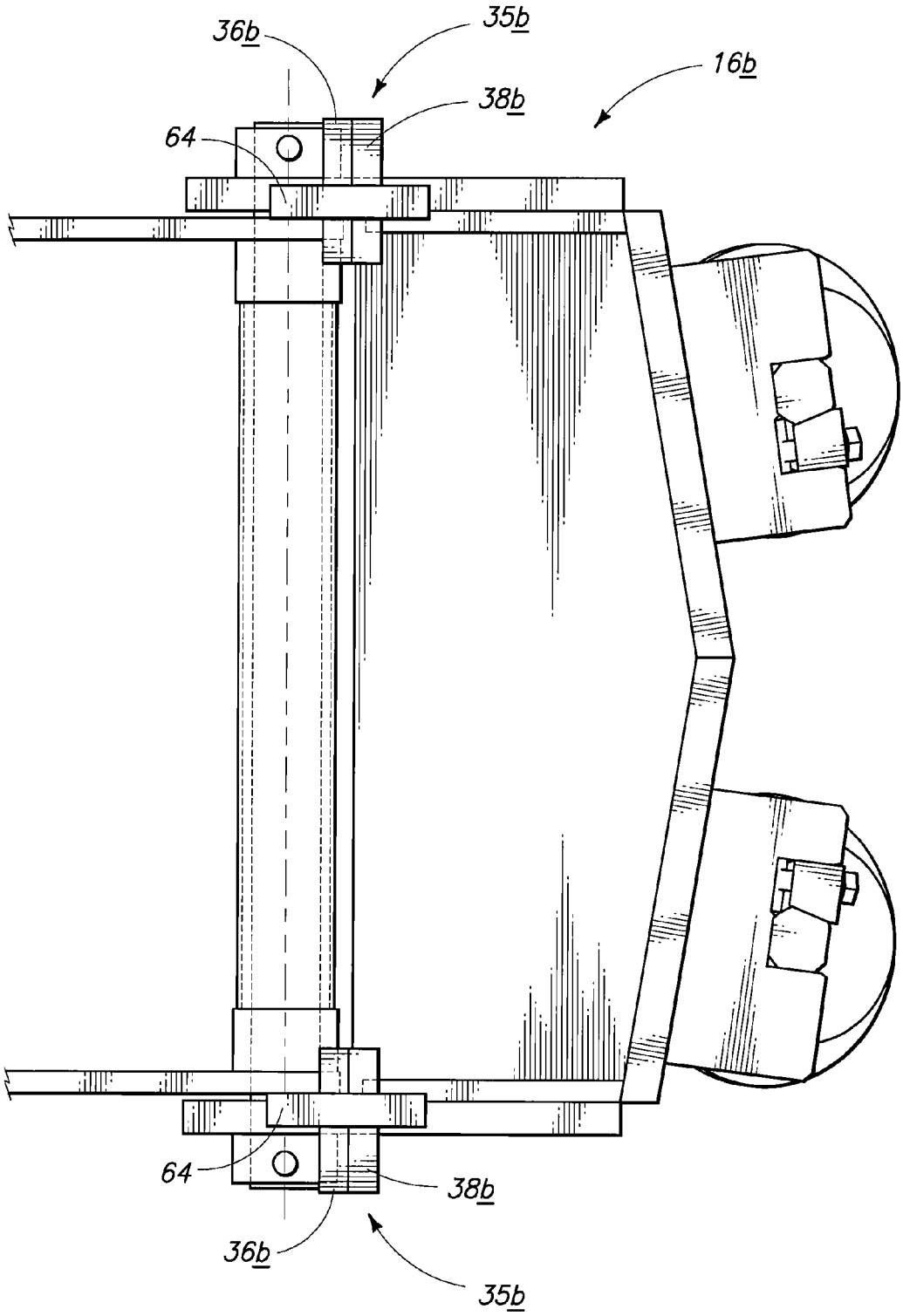
FIG. 9 is a diagrammatic top view of a portion of an alternate embodiment reamer arm assembly to that depicted by FIG. 3.
Figure 10:
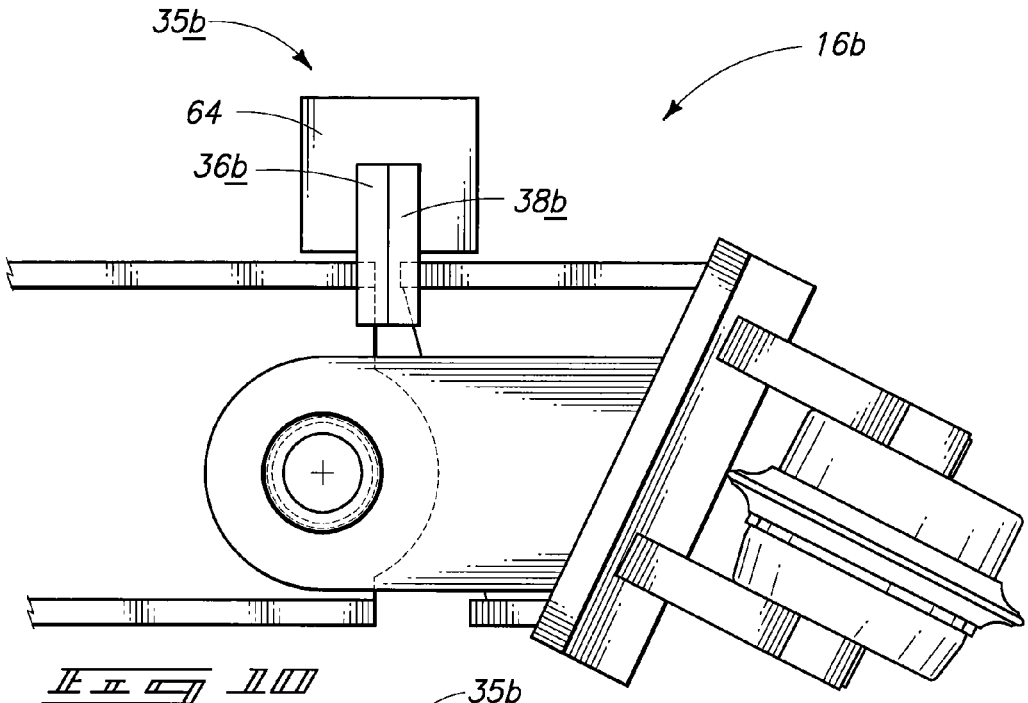
FIG. 10 is a side elevational view of the FIG. 9 drilling reamer arm assembly.
Figure 11:
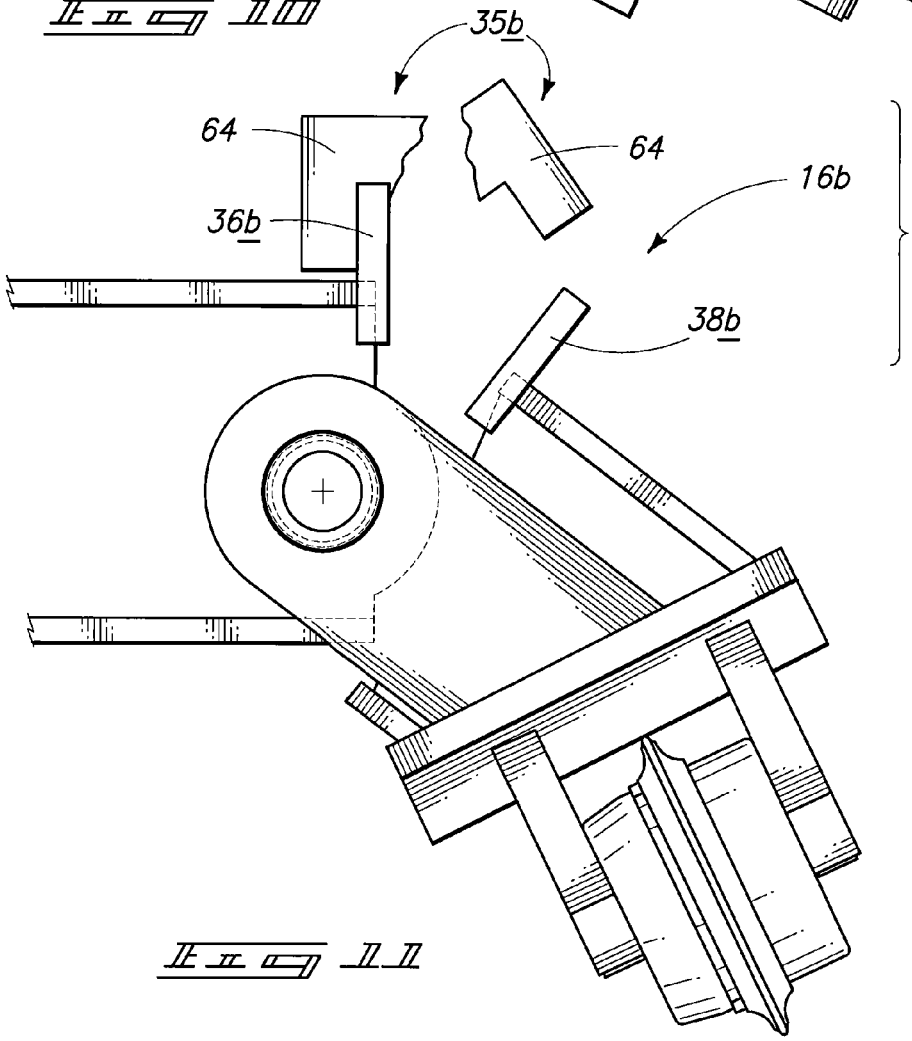
FIG. 11 is a side elevational view of the FIGS. 9 and 10 drilling reamer arm assembly in a different operational orientation to that depicted by FIG. 10.

FIGS. 9, 10, and 11 depict another example alternate embodiment drilling reamer arm assembly 16*b*, and correspond in orientation to that of FIGS. 3, 4, and 5, respectively. Like numerals from the first-described embodiments are utilized where appropriate, with differences being indicated with the suffix "b" or with different numerals. Breakaway retainers 35*b* in FIGS. 9-11 comprise U-shaped retainers 64 received over the tops and facing surfaces of the pair of compression members 36*b*, 38*b*. FIG. 11 depicts the failure of component 64 of a breakaway retainer 35*b* at least in part by failure in tension.

Figure 12:
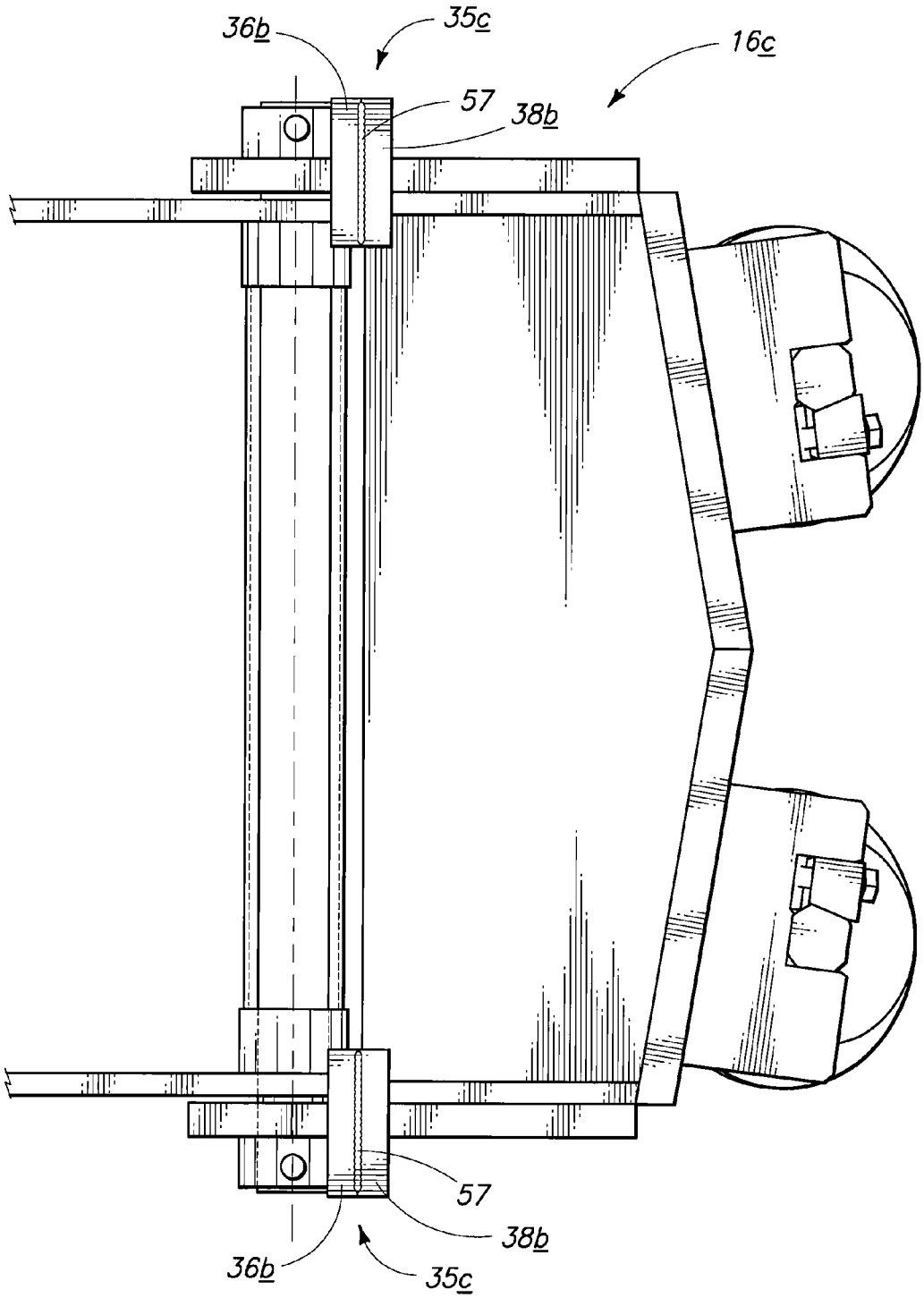
FIG. 12 is a diagrammatic top view of a portion of an alternate embodiment reamer arm assembly to that depicted by FIG. 3.
Figure 13:
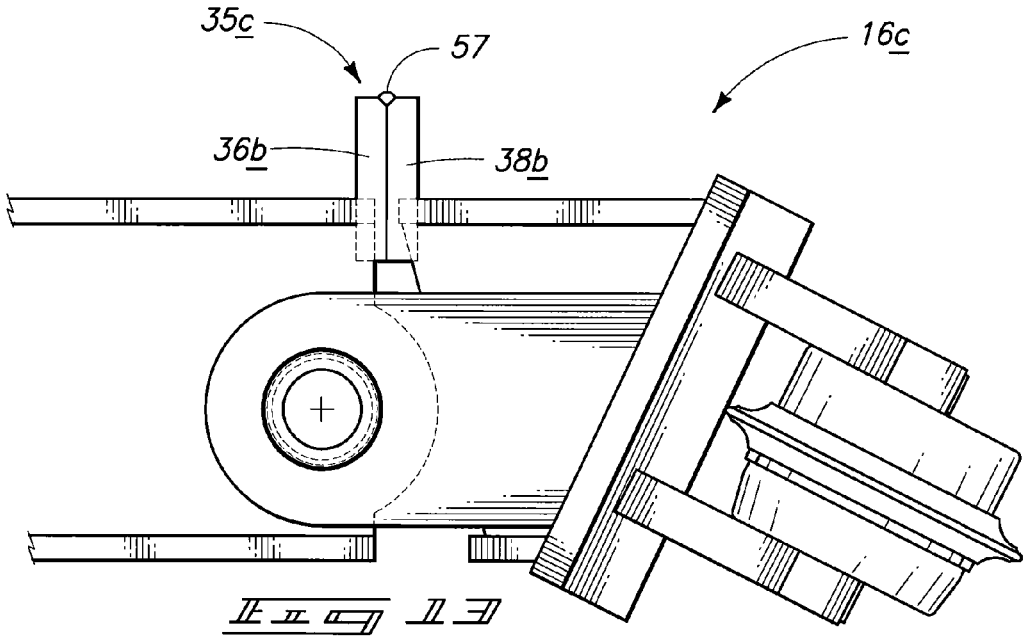
FIG. 13 is a side elevational view of the FIG. 12 drilling reamer arm assembly.
Figure 14:
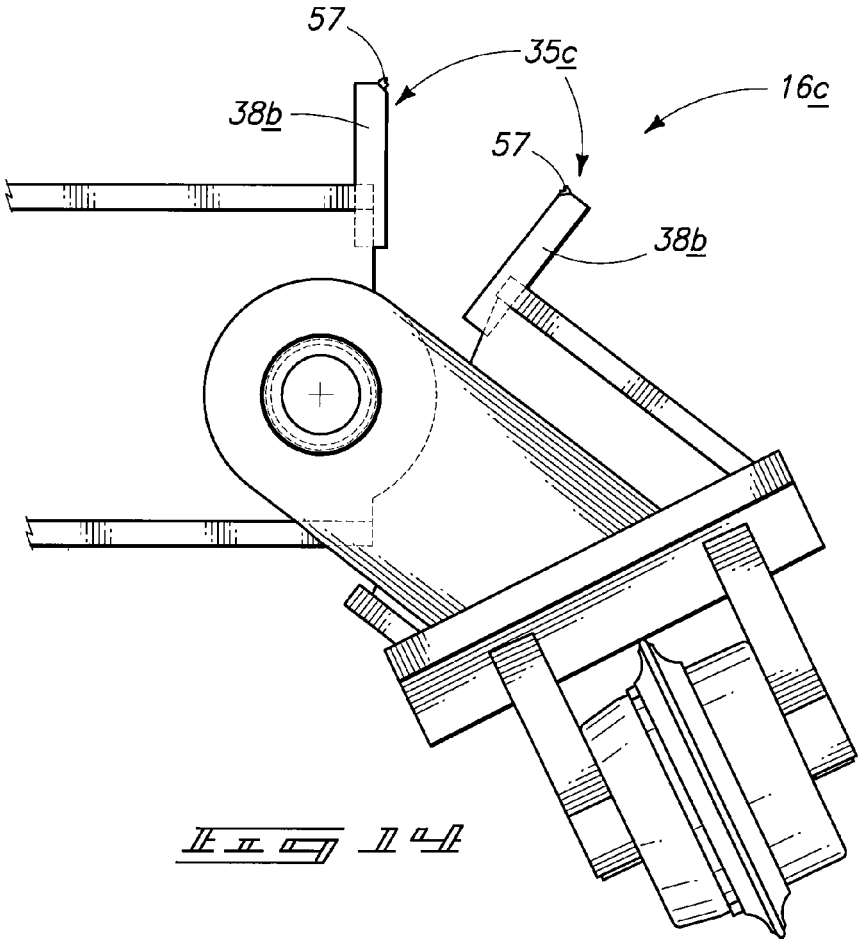
FIG. 14 is a side elevational view of the FIGS. 12 and 13 drilling reamer arm assembly in a different operational orientation to that depicted by FIG. 13.

Another alternate embodiment reamer arm assembly 16*c* is described with reference to FIGS. 12, 13, and 14, and corresponds in orientation to that of FIGS. 9, 10, and 11, respectively. Like numerals from the above-described embodiments are utilized where appropriate, with differences being indicated with the suffix "c" or with different numerals. FIGS. 12, 13, and 14 depict an alternate embodiment breakaway retainer 35*c* in the form of a weld 57 being provided or formed between compression members 36*b* and 38*b*. FIG. 14 depicts the failure of weld 57 in tension upon the application of an effective breakaway force.

Figure 15:
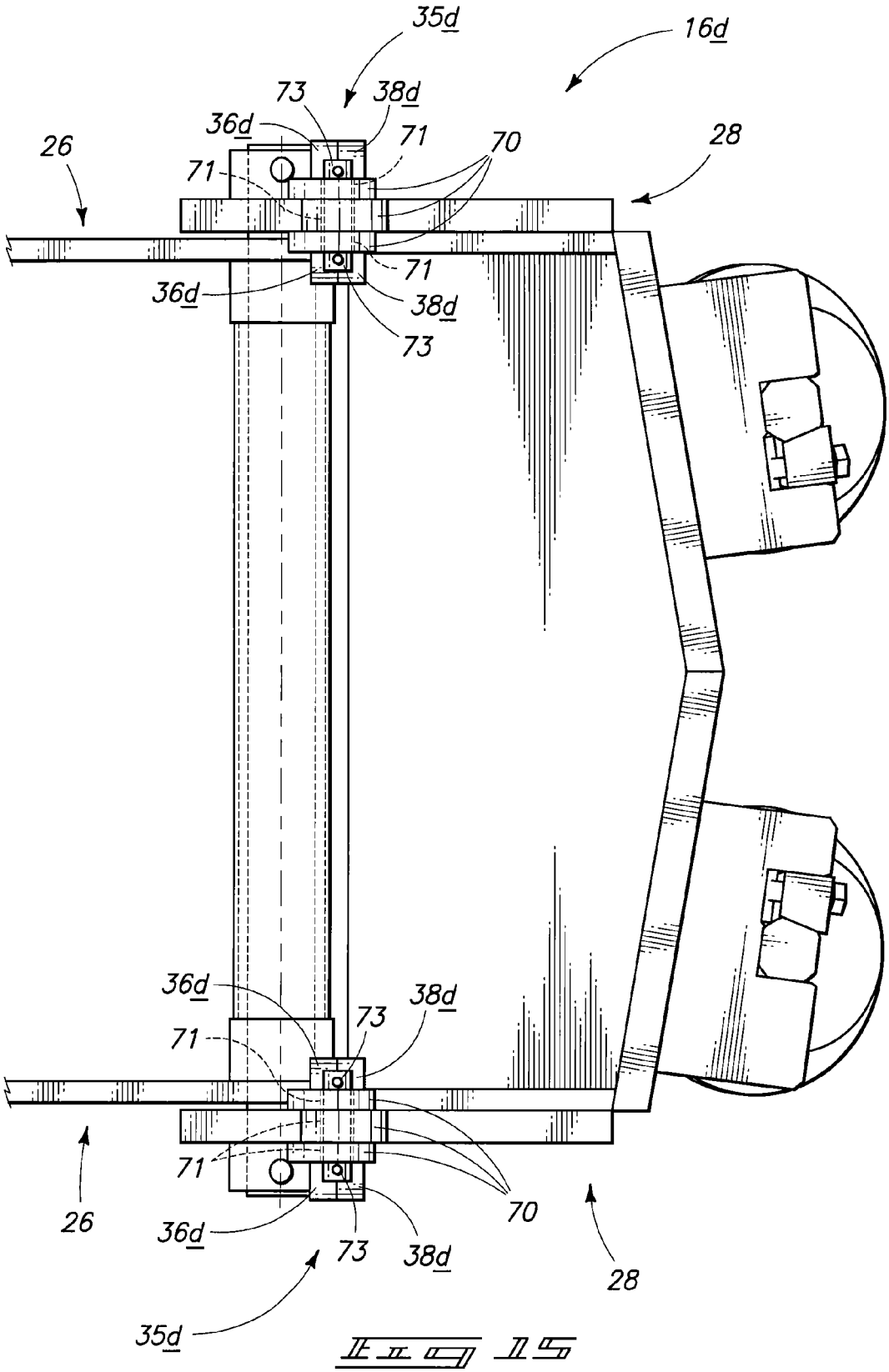
FIG. 15 is a diagrammatic top view of a portion of an alternate embodiment reamer arm assembly to that depicted by FIG. 3.
Figure 16:
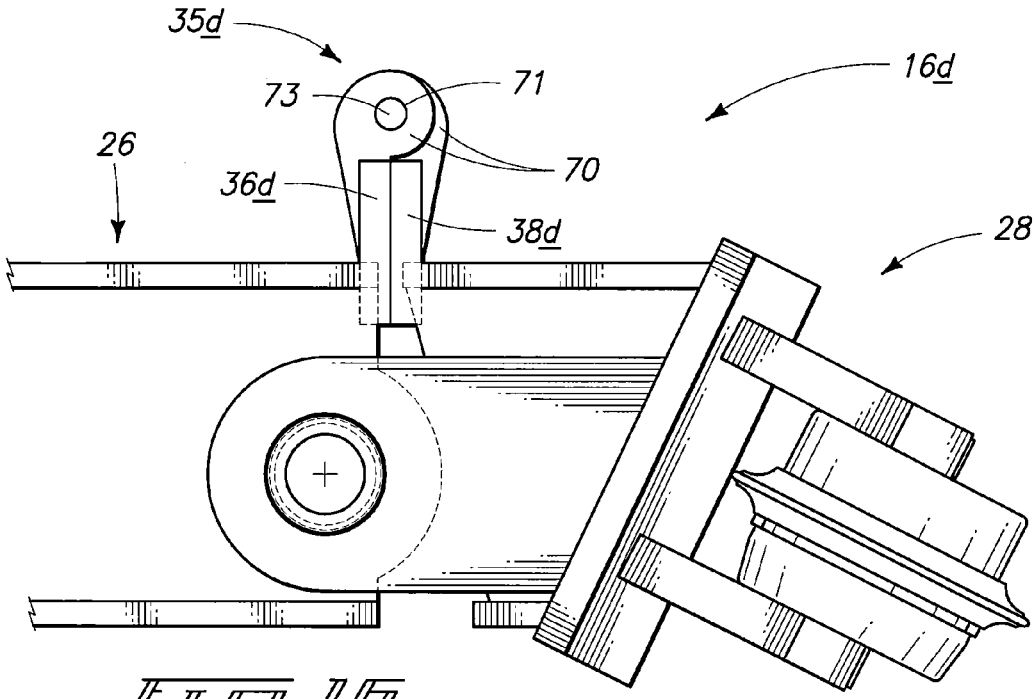
FIG. 16 is a side elevational view of the FIG. 15 drilling reamer arm assembly.
Figure 17:
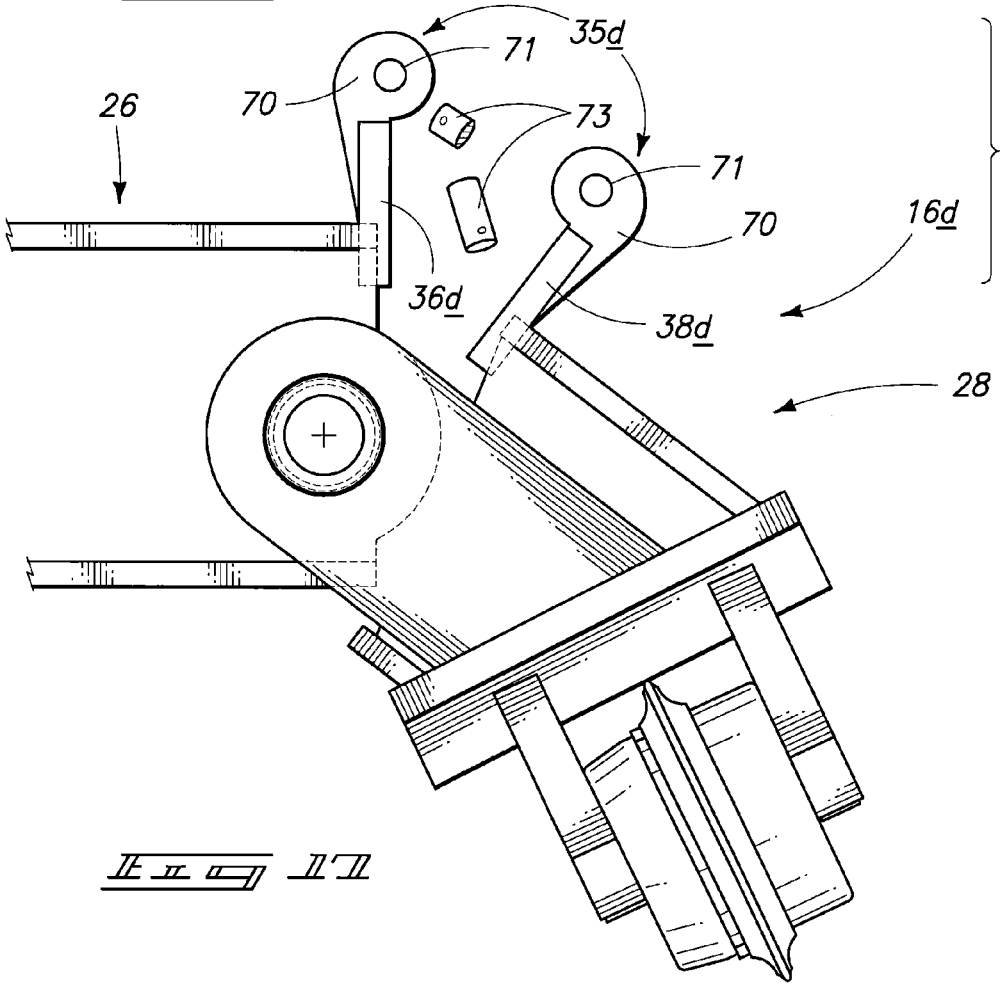
FIG. 17 is a side elevational view of the FIGS. 15 and 16 drilling reamer arm assembly in a different operational orientation to that depicted by FIG. 16.

In the above exemplary embodiment breakaway retainers, such were configured and oriented to fail entirely or primarily in tension upon the application of an effective breakaway force. Further in each, the component to fail was essentially radially oriented relative to the inner and outer portions to fail in tension. Alternate orientations for failure in tension are also of course contemplated. Further by way of example only, failure in other than tension, for example by shear or other means whether alone or in combination, are also contemplated. For example, FIGS. 15, 16, and 17 depict another alternate embodiment reamer arm assembly 16*d*. Like numerals from the first-described embodiment are utilized where appropriate, with differences being indicated with the suffix "d" or with different numerals. FIGS. 15, 16, and 17 correspond to FIGS. 3, 4, and 5 of the first-described embodiment. FIGS. 15-17 depict an embodiment wherein a breakaway retainer 35*d* is configured and oriented to fail in shear upon the application of an effective breakaway force. For example, compression members 36*d*, 38*d* comprise upwardly projecting portions 70 having respective transversely oriented holes 71 extending therethrough which are oriented to align with one another when facing surfaces 37 and 39 bear against one another. A suitable pin 73 is received through holes 71 in FIGS. 15 and 16, and thereby is transversely oriented relative to inner and outer portions 26, 28, respectively. FIG. 17 depicts the application of an effective breakaway causing pin 73 to fail in shear.

The above describes but example preferred embodiments of drilling reamer arm assemblies employing at least one preferred embodiment breakaway retainer. Other configurations are of course contemplated, as alluded to above. For example and by way of example only, interconnections other than by pivot or rotational action of a radial inner portion and radial outer portion relative to one another might alternately be used. For example, a suitable connection of a radial inner portion and an outer portion relative one another might occur by a suitable flexible cable or other interconnect whereby the failure of a breakaway retainer enables the outer portion to fall downwardly and radially inward away from the bore hole sidewalls upon application of an effective breakaway force. Other examples might also be employed, as will be appreciated by the artisan. Further, not all the individual reamer arm assemblies might be constructed to have a breakaway feature, although such is preferred.

Aspects of the invention also contemplate methods of drilling, for example utilizing any of the above contemplated individual reamer arm assemblies including at least one breakaway retainer. For example and by way of example only, one method of drilling comprises rotating a suitable drilling assembly into earthen material to form a bore hole. In one embodiment, a pulling force is at some point applied against the drilling assembly in a direction outwardly of the bore hole. The cutter of the radial outer portion of an individual reamer assembly contacts a sidewall of the bore hole at some point during application of such pulling force to impart an effective breakaway force to the at least one breakaway retainer causing it to break and enable the radial outer portion to move relative to the radial inner portion towards the cutting head apparatus and drive shaft. At some point thereafter, the broken breakaway retainer is replaced with an operable breakaway retainer. Then, the drilling assembly is rotated into earthen material to at least one of a) extend the existing bore hole, or b) form another bore hole.

In yet another embodiment, a method of drilling comprises rotating a drilling assembly into earthen material to form a bore hole. At some point, a pulling force is applied against the drilling assembly in a direction outwardly of the bore hole. At least some of the cutters of individual of the reamer arm assemblies contact a sidewall of the borehole at some point during application of such pulling force to impart a respective force against the respective breakaway retainers. However, none of the respective forces is effective to break any of the breakaway retainers. The drilling assembly is removed from the bore hole without breaking any of the breakaway retainers.

Accordingly, operation of the respective methods at least when considered in combination may or may not break any of the breakaway retainers.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A method of drilling, comprising:

rotating a drilling assembly into earthen material to form a borehole, the drilling assembly comprising:

a cutting head apparatus configured to cut into earthen material as the cutting head apparatus is rotated;

a drive shaft extending aft of and configured to rotate the cutting head apparatus; and a plurality of reamer arm assemblies projecting radially outward of the drive shaft and mounted for rotation therewith aft of the cutting head apparatus, individual of the reamer arm assemblies comprising:

a radial inner portion extending radially outward of the drive shaft;

a radial outer portion connected with and extending radially outward of the radial inner portion, the radial outer portion comprising a cutter; and at least one breakaway retainer fastening the radial inner and outer portions together which restrains the radial outer portion from moving relative to the radial inner portion towards the cutting head apparatus and the drive shaft;

applying a pulling force against the drilling assembly in a direction outwardly of the borehole, the cutter contacting a sidewall of the borehole at some point during application of said pulling force to impart an effective breakaway force to the at least one breakaway retainer causing the at least one breakaway retainer to break and enable the radial outer portion to move relative to the radial inner portion towards the cutting head apparatus and the drive shaft;

replacing the broken breakaway retainer with an operable breakaway retainer; and after the replacing, rotating the drilling assembly into earthen material to at least one of extend the borehole or form another borehole.

* * * * *